US009376860B2

(12) United States Patent
Josephson et al.

(10) Patent No.: US 9,376,860 B2
(45) Date of Patent: Jun. 28, 2016

(54) DOUBLE PLEAT CELLULAR SHADE ELEMENT

(75) Inventors: Paul F. Josephson, Firestone, CO (US); Thomas E. Sevcik, Fort Lupton, CO (US); Paul G. Swiszcz, Niwot, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/240,264

(22) PCT Filed: Aug. 27, 2012

(86) PCT No.: PCT/US2012/052493

§ 371 (c)(1),
(2), (4) Date: Apr. 18, 2014

(87) PCT Pub. No.: WO2013/033010

PCT Pub. Date: Mar. 7, 2013

(65) Prior Publication Data

US 2014/0224432 A1 Aug. 14, 2014

Related U.S. Application Data

(60) Provisional application No. 61/528,061, filed on Aug. 26, 2011, provisional application No. 61/528,068, filed on Aug. 26, 2011.

(51) Int. Cl.
*E06B 9/48* (2006.01)
*E06B 9/38* (2006.01)
(Continued)

(52) U.S. Cl.
CPC . *E06B 9/38* (2013.01); *E06B 9/262* (2013.01); *E06B 9/30* (2013.01); *E06B 2009/2627* (2013.01)

(58) Field of Classification Search
CPC ... E06B 2009/2627; E06B 9/262; E06B 9/30; E06B 9/38
USPC ..... 160/84.01, 84.04, 84.05, 59; 428/116, 428/178
See application file for complete search history.

(56) References Cited

U.S. PATENT DOCUMENTS 1,958,695 A 5/1934 Claus
2,118,134 A 5/1938 Allison
(Continued)

FOREIGN PATENT DOCUMENTS

CN 2545343 Y 4/2003
EP 0427477 A2 5/1991
(Continued)

OTHER PUBLICATIONS

PCT International Search Report and Written Opinion dated Oct. 26, 2012, PCT Application No. PCT/US2012/052473, 20 pages.
(Continued)

*Primary Examiner* — Blair M Johnson
(74) *Attorney, Agent, or Firm* — Dorsey & Whitney LLP

(57) ABSTRACT

A covering for an architectural opening is provided. The covering may include a head rail, an end rail, and a cellular panel operably connected between the head rail and the end rail. The cellular panel may include at least one cellular unit. Each cellular unit may include a primary cell having a first side and a second side. In one configuration, the first side has a single crease, and the second crease has three creases. An outer wall may be operably connected to the primary cell and extend around at least a portion of a side of the primary cell.

26 Claims, 14 Drawing Sheets

(51) Int. Cl.
*E06B 9/30* (2006.01)
*E06B 9/262* (2006.01)

(56) References Cited

U.S. PATENT DOCUMENTS

| | | | |
|---|---|---|---|
| 2,201,356 | A | 5/1940 | Terrell |
| 2,267,869 | A | 12/1941 | Loehr |
| RE22,311 | E | 5/1943 | Roy |
| 2,318,525 | A | 5/1943 | Renton |
| 2,350,200 | A | 5/1944 | Starr |
| 2,874,612 | A | 2/1959 | Luboshez |
| 3,190,086 | A | 6/1965 | Klein |
| 3,222,689 | A | 12/1965 | Efron et al. |
| D208,350 | S | 8/1967 | Cheris |
| 3,386,490 | A | 6/1968 | Kandel |
| 3,487,875 | A | 1/1970 | Shukat et al. |
| 3,490,515 | A | 1/1970 | Kandel |
| 3,566,499 | A | 3/1971 | James |
| 4,019,554 | A | 4/1977 | Rasmussen |
| 4,069,857 | A | 1/1978 | Brookshire |
| 4,282,919 | A | 8/1981 | Teno |
| 4,397,346 | A | 8/1983 | Chumbley et al. |
| D277,061 | S | 1/1985 | Picoy |
| 4,542,602 | A | 9/1985 | Hoverson |
| 4,675,060 | A | 6/1987 | Schnebly et al. |
| 4,677,013 | A | 6/1987 | Anderson |
| 4,739,816 | A | 4/1988 | Dodich et al. |
| 4,846,243 | A | 7/1989 | Schneider |
| 4,884,612 | A | 12/1989 | Schnebly et al. |
| 4,915,153 | A | 4/1990 | Toti |
| 4,921,032 | A | 5/1990 | May |
| 4,974,656 | A | 12/1990 | Judkins |
| 4,984,617 | A | 1/1991 | Corey |
| 5,090,098 | A | 2/1992 | Seveik et al. |
| 5,129,440 | A | 7/1992 | Colson |
| 5,158,632 | A | 10/1992 | Colson |
| 5,193,601 | A | 3/1993 | Corey et al. |
| 5,205,333 | A | 4/1993 | Judkins |
| 5,205,334 | A | 4/1993 | Judkins |
| 5,207,257 | A | 5/1993 | Rupel et al. |
| 5,228,936 | A | 7/1993 | Goodhue |
| 5,231,708 | A | 8/1993 | Hansen |
| 5,313,998 | A | 5/1994 | Colson et al. |
| 5,313,999 | A | 5/1994 | Colson et al. |
| 5,355,555 | A | 10/1994 | Zarelius |
| 5,409,050 | A | 4/1995 | Hong |
| 5,425,408 | A | 6/1995 | Colson |
| 5,490,533 | A | 2/1996 | Carter |
| 5,490,553 | A | 2/1996 | Colson et al. |
| 5,503,210 | A | 4/1996 | Colson et al. |
| 5,547,006 | A | 8/1996 | Auger |
| 5,558,925 | A | 9/1996 | Fritzman |
| 5,560,976 | A | 10/1996 | Huang |
| 5,566,735 | A | 10/1996 | Jelic |
| 5,620,035 | A | 4/1997 | Judkins |
| 5,632,316 | A | 5/1997 | Cohen |
| 5,645,504 | A | 7/1997 | Westhoff |
| 5,649,583 | A | 7/1997 | Hsu |
| 5,680,891 | A | 10/1997 | Prince |
| 5,690,156 | A | 11/1997 | Ruggles |
| 5,706,876 | A | 1/1998 | Lysyj |
| 5,714,034 | A | 2/1998 | Goodhue |
| 5,733,632 | A | 3/1998 | Marusak |
| 5,746,266 | A | 5/1998 | Colson et al. |
| 5,787,951 | A | 8/1998 | Tonomura et al. |
| 5,791,390 | A | 8/1998 | Watanabe |
| 5,855,235 | A | 1/1999 | Colson et al. |
| 5,897,731 | A | 4/1999 | Colson et al. |
| 5,918,655 | A | 7/1999 | Corey |
| 5,960,847 | A | 10/1999 | Crider et al. |
| 5,974,763 | A | 11/1999 | Colson et al. |
| 6,006,812 | A | 12/1999 | Corey |
| 6,033,504 | A | 3/2000 | Judkins |
| 6,103,336 | A | 8/2000 | Swiszcz |
| 6,112,797 | A | 9/2000 | Colson et al. |
| D436,783 | S | 1/2001 | Cooper et al. |
| 6,223,802 | B1 | 5/2001 | Colson |
| D443,455 | S | 6/2001 | Hynniman |
| 6,257,300 | B1 | 7/2001 | Brownlie |
| 6,289,964 | B1 | 9/2001 | Colson et al. |
| D448,594 | S | 10/2001 | Throne |
| 6,302,181 | B1 | 10/2001 | Rupel |
| 6,345,486 | B1 | 2/2002 | Colson et al. |
| 6,354,353 | B1 | 3/2002 | Green et al. |
| 6,461,464 | B1 | 10/2002 | Swiszcz |
| 6,484,786 | B1 | 11/2002 | Ruggles et al. |
| 6,497,264 | B1 | 12/2002 | Paskevicius |
| D468,950 | S | 1/2003 | Judkins |
| 6,520,238 | B2 | 2/2003 | Allsopp |
| 6,550,519 | B2 | 4/2003 | Green et al. |
| 6,572,725 | B2 | 6/2003 | Goodhue |
| 6,595,262 | B2 | 7/2003 | Chen |
| 6,601,637 | B2 | 8/2003 | Toti |
| 6,662,845 | B1 | 12/2003 | Palmer |
| 6,675,859 | B2 | 1/2004 | Nien |
| 6,688,373 | B2 | 2/2004 | Corey et al. |
| 6,740,389 | B2 * | 5/2004 | Yu ..... B31D 3/0215 160/348 |
| 6,792,994 | B2 | 9/2004 | Lin |
| 6,792,996 | B1 | 9/2004 | Yu et al. |
| D498,105 | S | 11/2004 | Tyner |
| 6,834,702 | B2 | 12/2004 | Nien |
| D501,749 | S | 2/2005 | Gruner |
| 6,932,138 | B2 | 8/2005 | Yu et al. |
| 6,978,821 | B2 | 12/2005 | Welfonder |
| 6,988,526 | B2 | 1/2006 | Judkins |
| D514,859 | S | 2/2006 | Herhold |
| D515,345 | S | 2/2006 | Herhold et al. |
| 7,021,359 | B2 | 4/2006 | Yu et al. |
| 7,111,659 | B2 | 9/2006 | Harper et al. |
| 7,117,917 | B2 | 10/2006 | Allsopp |
| 7,117,919 | B2 | 10/2006 | Judkins |
| 7,124,802 | B2 | 10/2006 | Sudano |
| 7,143,802 | B2 | 12/2006 | Strand et al. |
| 7,147,029 | B2 | 12/2006 | Kovach et al. |
| 7,159,634 | B1 | 1/2007 | Judkins |
| 7,191,816 | B2 | 3/2007 | Colson et al. |
| 7,207,370 | B2 | 4/2007 | Snyder et al. |
| 7,237,591 | B2 | 7/2007 | Snyder et al. |
| 7,275,580 | B2 | 10/2007 | Yu et al. |
| 7,290,582 | B2 | 11/2007 | Lin |
| 7,311,131 | B2 | 12/2007 | Nien et al. |
| 7,337,822 | B2 | 3/2008 | Snyder et al. |
| 7,353,856 | B2 | 4/2008 | Pon et al. |
| D568,082 | S | 5/2008 | Bohlen |
| 7,415,845 | B1 | 8/2008 | Graichen |
| 7,500,505 | B2 | 3/2009 | Smith et al. |
| 7,513,292 | B2 | 4/2009 | Auger et al. |
| 7,523,777 | B2 | 4/2009 | Kim |
| 7,549,455 | B2 | 6/2009 | Harper et al. |
| 7,578,334 | B2 | 8/2009 | Smith et al. |
| 7,588,068 | B2 | 9/2009 | Colson et al. |
| D605,885 | S | 12/2009 | Judkins |
| 7,637,301 | B2 | 12/2009 | Forst Randle |
| 7,730,931 | B2 | 6/2010 | Stern |
| D622,964 | S | 9/2010 | Colson |
| D623,419 | S | 9/2010 | Swiszcz et al. |
| 7,832,450 | B2 | 11/2010 | Brace et al. |
| D632,492 | S | 2/2011 | Colson et al. |
| D632,493 | S | 2/2011 | Colson et al. |
| D636,204 | S | 4/2011 | Elinson et al. |
| D640,472 | S | 6/2011 | Colson et al. |
| D640,875 | S | 7/2011 | Colson et al. |
| 7,971,624 | B2 | 7/2011 | Harper et al. |
| D646,516 | S | 10/2011 | Ehrsam |
| 8,151,857 | B2 | 4/2012 | Colson et al. |
| 8,171,640 | B2 | 5/2012 | Colson et al. |
| D663,147 | S | 7/2012 | Cheng |
| D668,090 | S | 10/2012 | Colson et al. |
| 8,393,080 | B2 | 3/2013 | Ballard, Jr. et al. |
| D685,210 | S | 7/2013 | Josephson et al. |
| D686,022 | S | 7/2013 | Sevcik |
| 8,496,768 | B2 | 7/2013 | Holt et al. |
| D693,600 | S | 11/2013 | Jelic et al. |

(56) References Cited

U.S. PATENT DOCUMENTS

| | | | |
|---|---|---|---|
| 8,607,838 | B2 | 12/2013 | Colson et al. |
| 8,763,673 | B2 | 7/2014 | Jelic et al. |
| 9,249,618 | B2 * | 2/2016 | Sevcik ..... E06B 9/30 |
| 2002/0043346 | A1 | 4/2002 | Zorbas |
| 2002/0043347 | A1 | 4/2002 | Rupel |
| 2004/0065417 | A1 | 4/2004 | Vanpoelvoorde |
| 2005/0087309 | A1 | 4/2005 | Nien et al. |
| 2005/0155721 | A1 | 7/2005 | Pon |
| 2006/0048901 | A1 | 3/2006 | Nien |
| 2006/0225846 | A1 | 10/2006 | Marusak et al. |
| 2007/0010147 | A1 | 1/2007 | Swiszcz |
| 2007/0074826 | A1 | 4/2007 | Jelic et al. |
| 2008/0286569 | A1 | 11/2008 | Husemann et al. |
| 2010/0095535 | A1 | 4/2010 | Akins et al. |
| 2010/0126675 | A1 | 5/2010 | Jelic et al. |
| 2010/0186903 | A1 | 7/2010 | Liang et al. |
| 2010/0276089 | A1 | 11/2010 | Jelic et al. |
| 2010/0288446 | A1 | 11/2010 | Foley et al. |
| 2011/0088852 | A1 | 4/2011 | Hu et al. |
| 2012/0103537 | A1 | 5/2012 | Dogger |
| 2012/0175068 | A1 | 7/2012 | Cleaver |
| 2012/0175069 | A1 | 7/2012 | Rupel et al. |
| 2013/0133840 | A1 | 5/2013 | Malkan |
| 2013/0139977 | A1 | 6/2013 | Ballard et al. |
| 2013/0180669 | A1 | 7/2013 | Judkins |
| 2014/0096915 | A1 | 4/2014 | Colson et al. |
| 2014/0168779 | A1 | 6/2014 | Malkan |
| 2014/0284004 | A1 | 9/2014 | Sevcik et al. |
| 2015/0041072 | A1 | 2/2015 | Hsu et al. |

FOREIGN PATENT DOCUMENTS

| | | | |
|---|---|---|---|
| EP | 0451912 | A1 | 10/1991 |
| EP | 0482794 | A1 | 4/1992 |
| EP | 0654577 | A1 | 5/1995 |
| EP | 0779407 | A1 | 6/1997 |
| EP | 1213435 | A2 | 6/2002 |
| EP | 1431506 | A2 | 6/2004 |
| EP | 1479867 | A2 | 11/2004 |
| EP | 1561896 | A2 | 8/2005 |
| EP | 1561986 | A1 | 8/2005 |
| EP | 1619348 | A1 | 1/2006 |
| GB | 1494842 | A | 12/1977 |
| JP | 37-26369 | | 9/1937 |
| JP | 6-173549 | | 6/1994 |
| JP | 7039449 | A | 2/1995 |
| JP | 9-221969 | | 8/1997 |
| TW | 549344 | | 8/2003 |
| WO | 85/02760 | A1 | 7/1985 |
| WO | 88/07345 | A1 | 10/1988 |
| WO | 93/07353 | A1 | 4/1993 |
| WO | 94/29559 | A1 | 12/1994 |
| WO | 2005019584 | A2 | 3/2005 |
| WO | 2005062875 | A2 | 7/2005 |
| WO | 2005081948 | A2 | 9/2005 |
| WO | 2006023751 | A2 | 3/2006 |
| WO | 2006098853 | A2 | 9/2006 |

OTHER PUBLICATIONS

PCT International Search Report and Written Opinion dated Nov. 19, 2012, PCT Application No. PCT/US2012/52485, 17 pages.

PCT International Search Report dated Jan. 2, 2013, PCT Application No. PCT/US2012/052493, 4 pages.

Author Unknown, "Poliformas Plasticas—Resinas Poliester—Fibra de Vidrio", www.poliformasplasticas.com/mx/2011/innova_laminas.php (2010), 4 pages.

Author Unknown, "Roman Shades", seamstobe.com/Romanshades.htm, at least as early as May 26, 2009, 2 pages.

Author Unknown, "Understanding Roman Shades", terrelldesigns.com, at least as early as May 26, 2009, 4 pages.

* cited by examiner

DOUBLE PLEAT CELLULAR SHADE ELEMENT

CROSS-REFERENCE TO RELATED APPLICATIONS

This application is the national stage application of International Patent Application No. PCT/US2012/052493 filed Aug. 27, 2012, entitled "Double Pleat Cellular Shade Element", which claims the benefit under 35 U.S.C. 119(e) of U.S. Provisional Application No. 61/528,061, filed Aug. 26, 2011, entitled "Double Pleat Cellular Shade Element," and U.S. Provisional Application No. 61/528,068, filed Aug. 26, 2011, and entitled "Double Pleat Cellular Shade With Vanes," which are hereby incorporated by reference herein in their entireties. This application also is related to co-pending U.S. Design Patent Application No. 29/400,375, now U.S. Design Patent No. D685,210, filed Aug. 26, 2011, and entitled "Cellular Shade Component."

FIELD

The present invention relates generally to coverings for architectural openings and more specifically, to cellular coverings for architectural openings.

BACKGROUND

Coverings for architectural openings, such as windows, doors, archways, and the like, have taken numerous forms for many years with some of these coverings being retractable in nature so as to be movable between an extended position across the opening and a retracted position adjacent one or more sides of the opening.

More recently, retractable coverings have been made in a cellular format. The cells in such coverings are typically elongated tubes or cells that extend laterally across an opening. When the covering is open and extended across a window opening, the cells are themselves expanded, but when the covering is retracted, the cells collapse so that each cell is stacked with the adjacent cell, and collectively stacked together in a small space.

SUMMARY

Examples of the disclosure may including a covering for an architectural opening. The covering includes a head rail, an end rail or bottom rail, and a cellular panel operably connected to and extending between the head rail and the end rail. The cellular panel includes at least one cellular unit, and each cellular unit includes a primary cell and a second cell. The primary cell has a first side and a second side, each of which may have at least one crease. In one example, the first side has a single or first crease, and the second side has three creases, particularly a second crease, a third crease, and a fourth crease. To form the secondary or outer cell, an outer wall may be operably connected to the primary cell and extend around or coextensive with at least a portion of the first side of the primary cell.

Other examples of the disclosure may include a cellular shade. The cellular shade includes at least two cellular units. Each cellular unit includes an inner cell and an outer cell. The inner cell has a first side and a second side, each of which may have at least one pleat. In one example, the first side has a single pleat and the second side has at least two pleats. The outer cell is defined by an outer wall operably connected to the first side of the inner cell. The outer wall may include at least one pleat, and in one example the outer wall includes a single pleat. The outer cell may extend substantially the height of the inner cell. Additionally, the cellular panel includes a lift mechanism for extending and retracting the at least two cellular units. The cellular units are therefore movable between an extended position and a stacked position. In the stacked position, the stack height of each side of the cellular panel is approximately equal, and the depth is greater for a front side of the cellular panel but shorter for a back side of the cellular panel.

This summary of the disclosure is given to aid understanding, and one of skill in the art will understand that each of the various aspects and features of the disclosure may advantageously be used separately in some instances, or in combination with other aspects and features of the disclosure in other instances.

DETAILED DESCRIPTION

Overview

Figure 1:
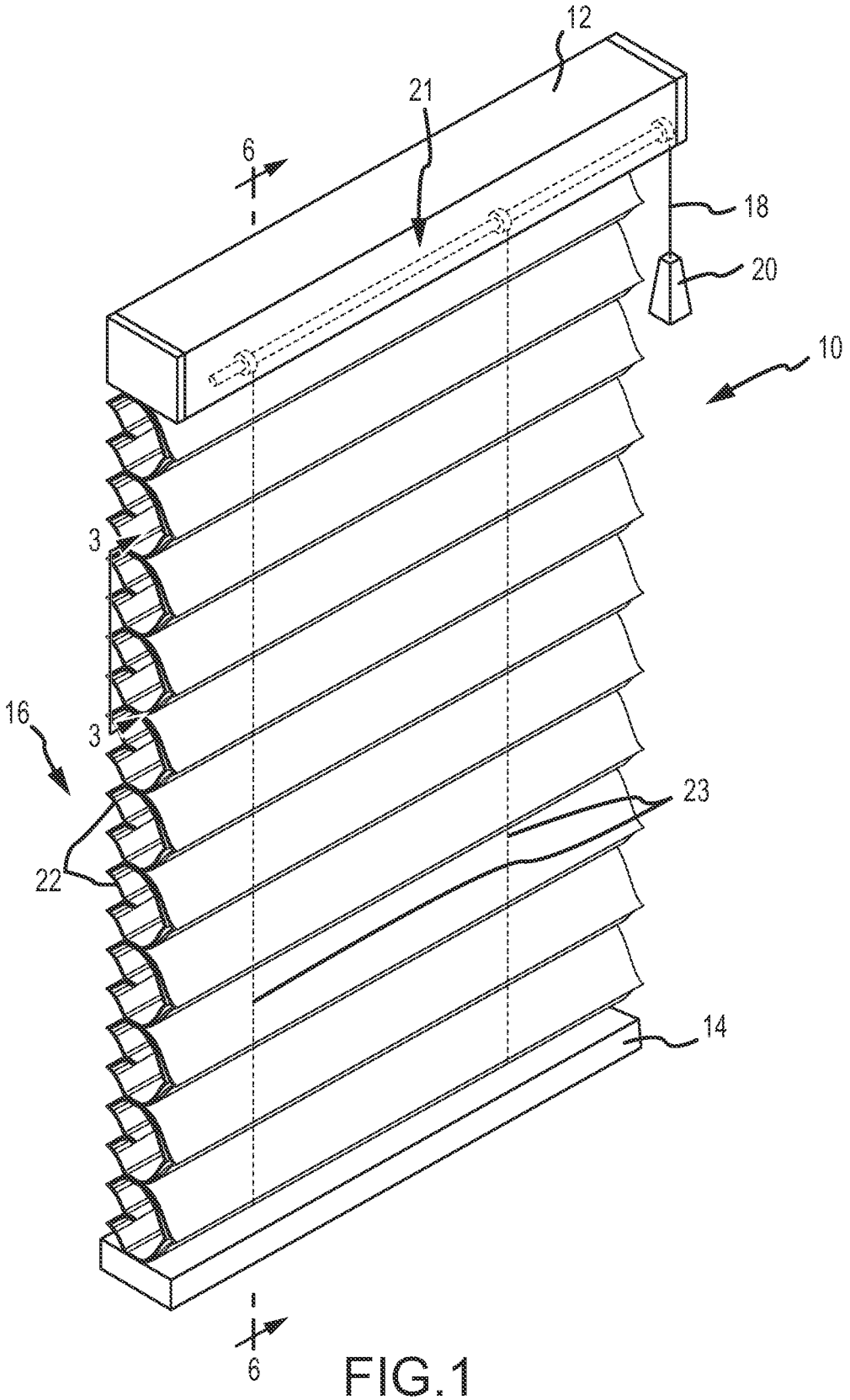
FIG. 1 is an isometric view of a covering for an architectural opening in an extended position.

A cellular covering typically includes a plurality of elongated vertically aligned, laterally extending, transversely collapsible cells which are longitudinally adhered to adjacent cells to form a vertical stack of cells. The transverse cross-section of each cell can take numerous forms such as hexagonal, octagonal, or variations thereof. While such coverings utilizing transversely collapsible cells are typically oriented so the cells extend laterally or horizontally, panels of such material can also be oriented so the cells extend vertically or at an angle between horizontal and vertical.

In some embodiments herein, a cellular shade having a double pleated or creased primary or inner cell and a single creased outer or secondary cell operably connected to the primary cell is disclosed. The cellular shade or panel may include at least two cellular units longitudinally aligned, where each cellular unit includes a primary or inner cell and a secondary or outer cell.

The primary cell includes a first side and a second side. The first side of the cell may have a single crease or pleat and the second side of the cell may have multiple creases or pleats, thus as the cellular unit is collapsed the first side of the cell may bend or fold at a single location or line and the second side of the cell may bend or fold at multiple locations. In some examples, one crease on the second side of the cell may be an inner crease having an apex directed towards the inner volume of the cell. This cell configuration allows for the cellular panel to have a reduced depth for a similar drop-length as other cell constructions. This allows for the cellular panel to fit into smaller depth architectural openings, e.g., low-depth window frames, while still providing for a larger drop and cellular length appearance. For example, a first side of a cell may appear to have a large height dimension, but the cell may fit into an architectural opening with a relatively low depth.

In addition to the primary cell, each cellular unit may also include a secondary cell. The secondary cell may be formed by a strip of material or outer wall that may be operably connected to the primary cell, and the cell may be defined by the strip of material and a sidewall of the primary cell. The outer wall defines a cavity extending along a length of the primary cell, and may extend from the top edge to the bottom edge of the primary cell. The cavity of the second cell provides an additional layer of insulation, without requiring multiple additional material layers to create the secondary cell. Furthermore, the secondary cell may be positioned on the side of the cellular panel that may face towards the room (e.g., away from the architectural opening). In these instances, the outer wall of the secondary cell may be a more expensive or better quality material (i.e., woven fabric with rich color and texture) which may be the only material visible by the user. Because the outer materials forming the primary cell may be less expensive since they are hidden from the user by the outer wall, this structure may be generally less expensive than another comparative cellular panel including two separate rows of cells. Also, the secondary cell may provide the appearance of a cell having a larger height without breaks, which is believed by some to provide a more aesthetically pleasing result.

Also, the secondary or front cell formed by the outer wall may also provide additional material to allow the cellular panel to stack in a balanced manner. For example, multiple pleats may be formed by multiple crease lines on a second side of the primary cell and may increase the thickness of the rear side of the cellular panel. The additional material of the outer wall increases the front thickness of the stacked panel, to balance the panel.

Description of Figures

Figure 2:
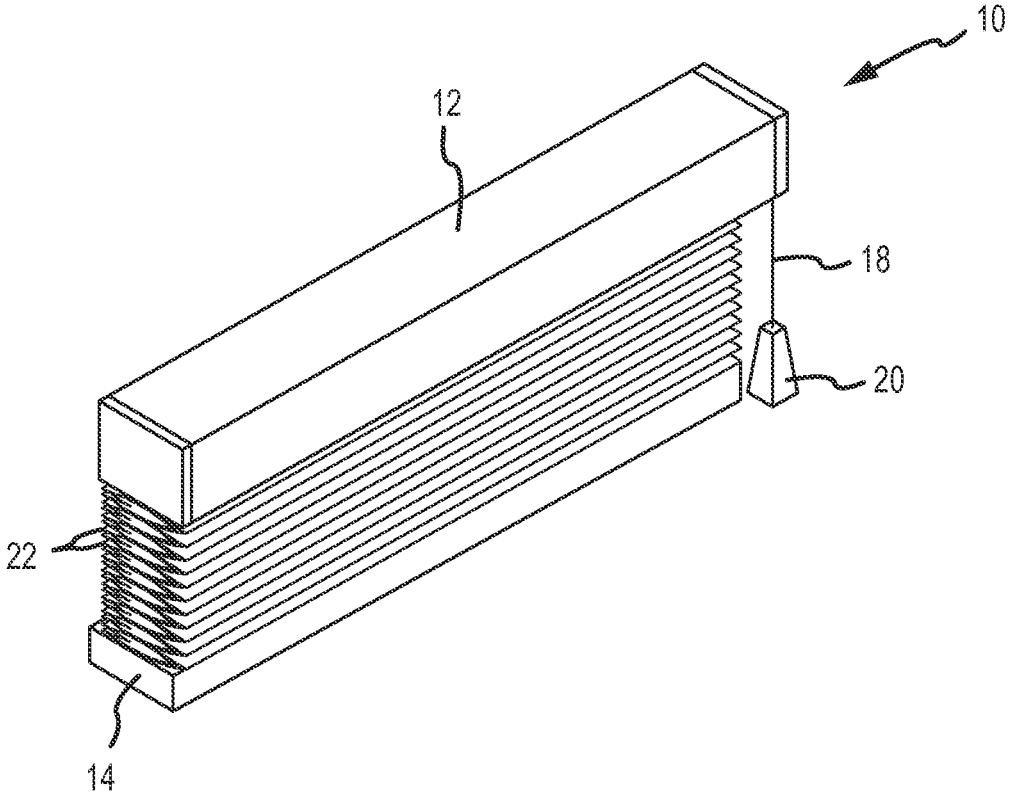
FIG. 2 is an isometric view of the covering of FIG. 1 in a retracted position.

FIG. 1 is an isometric view of a covering 10 for an architectural opening in an extended position. The covering 10 includes a plurality of elongated vertically aligned, laterally extending, transversely collapsible cellular units 22 which are longitudinally adhered to adjacent cellular units 22 to form a vertical stack of cellular units 22. The covering 10 may include at least two cellular units 22 longitudinally aligned, with each cellular unit having a primary or inner cell and a secondary or outer cell. In some embodiments, each cellular unit 22 has a double pleated or creased primary or inner cell and a single creased outer or secondary cell operably connected to the primary cell. FIG. 2 is an isometric view of the covering 10 in a retracted or stacked position with the cellular units 22 collapsed. The covering 10 may include a head rail 12, a bottom or end rail 14, and a flexible cellular panel 16 made up of a plurality of cellular units 22 interconnecting the head rail 12 and the bottom rail 14. The covering 10 may be moved from the extended position illustrated in FIG. 1 to the retracted position illustrated in FIG. 2 by operating a control cord 18 having a tassel 20 located on a free end of the control cord 18. The control cord 18 may be connected to a lift mechanism 21, which may include a lift cord 23, a drive mechanism, a pulley, a roller, and/or other suitable features known in the art. The lift mechanism 21 is anchored in the head rail 12 and may extend through the panel 16 from the head rail 12 to the bottom rail 14 and is operative to selectively lift the bottom rail 14 towards the head rail 12. To extend the covering 10, the tassel 20 may rise, providing extra length to the lift mechanism 21, and the bottom rail 14 (through gravity) may drop. In other examples, the covering 10 may include alternate control and/or lift mechanisms, such as an automatic or motorized system, pulley system, and so on. The automatic system may be electrical or spring driven, for example.

Figure 3:
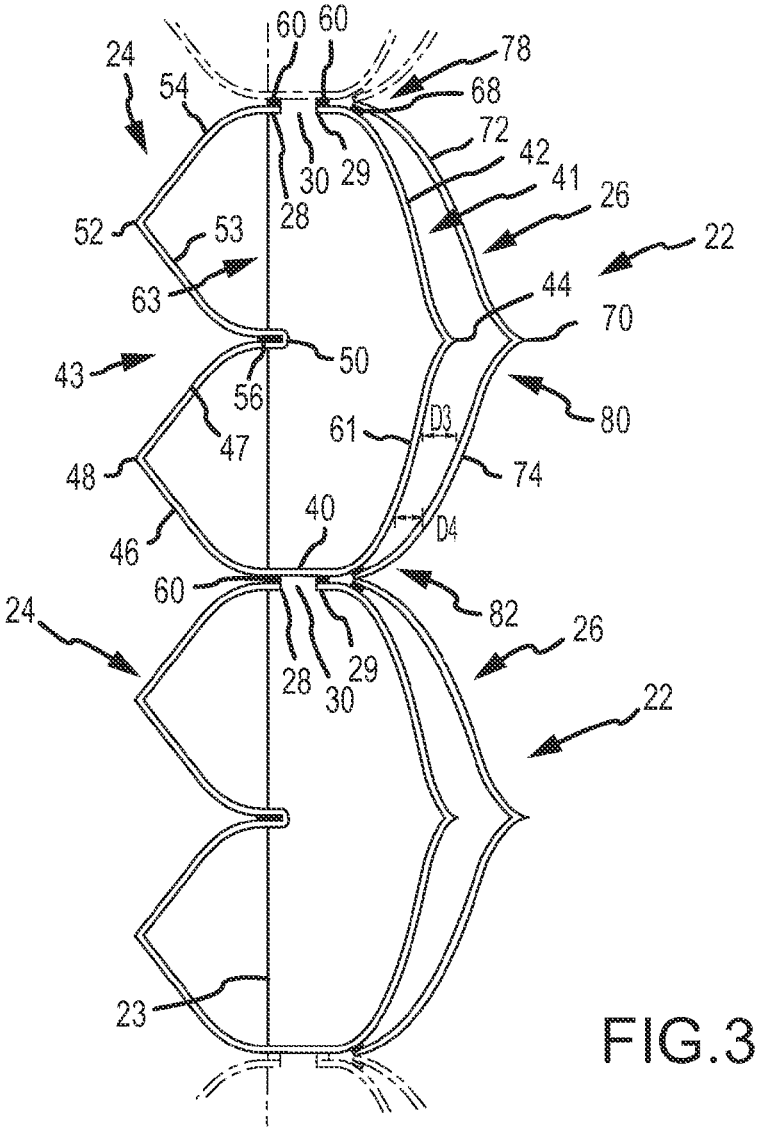
FIG. 3 is an enlarged side elevation view of the covering of FIG. 1 taken along the line 3-3 as shown in FIG. 1.

Referring to FIG. 1, the panel 16 may include a plurality of cellular units 22 or rows. Each cellular unit 22 may extend horizontally or laterally across the width of the panel 16 and may be vertically aligned with each other cellular unit 22. Each cellular unit 22 may be operably connected along its length to immediately adjacent upper and lower cellular units 22 (described in more detail below). Additionally, each cellular unit 22 may be transversely collapsible, such that as the covering 10 is retracted, the cellular units 22 may reduce in height and stack together. For example, the cross-sectional area of each cellular unit 22 taken at a right angle with respect to the length of the panel 16 collapses in a desired way to allow stacking FIG. 3 is a cross-section view of the panel 16 in an extended position. As shown in FIG. 3, each cellular unit 22 may include a primary cell 24 and a secondary cell 26.

The Primary Cell

Referring to FIG. 3, the primary or inner cell 24 may be formed from a strip of material having two longitudinal edges 28, 29. The material of the primary cell 24 may be woven, non-woven, knit, fabric, plastic sheet, manmade, natural, a combination of materials, a laminate, or so on. The material of the primary cell 24 may be blackout, opaque, clear, or have substantially any level of light transmissivity or translucence.

The longitudinal edges 28, 29 are secured together, either overlapping, adjacent one another, or spaced apart, to form a top 30 of the primary cell 24. In one example, the longitudinal edges 28, 29 may be secured via lines of adhesive 60 positioned on an outer surface of each edge 28, 29 which may secure the edges 28, 29 to an outer surface of a bottom 40 of an adjacent primary cell 24. However, in other examples, the longitudinal edges 28, 29 may be connected to adjacent cellular units 22 in other manners (e.g., fasteners). In examples where the two longitudinal edges 28, 29 may be spaced apart but adjacent one another, a top 30 of the primary cell 24 may be formed by the combination of the longitudinal edges 28, 29 and the outer surface of the bottom 40 of an adjacent primary cell. Alternatively, the longitudinal edges 28, 29 may form the bottom 40 of the primary cell 24. The top 30 and/or bottom 40 of the primary cell 24 may be connected to an adjacent cell via lines of adhesive 60 positioned on an outer surface of the top 30 and/or bottom 40. Although not depicted, other suitable methods of connection, such as stitching, may be used. Generally, the top 30 and the bottom 40 of the primary cell 24 are spatially or vertically separated from each other to define a height of the cell 24.

In addition to the top 30 and the bottom 40, each primary cell 24 includes two spatially or laterally separated sides, generally referred to as a first side 41 and a second side 43 herein for convenience purposes, that extend between the top 30 and the bottom 40 of the cell 24. The first side 41 is positioned so that it generally faces towards the room of the architectural opening (although it may be covered by the material forming the secondary cell 26). The second side 43 opposes the first side 41 and generally faces the road-side of the architectural opening.

Figure 4:
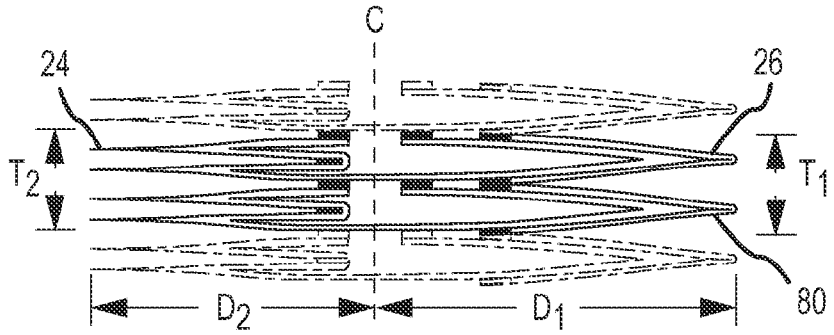
FIG. 4 is a side elevation view of the two cellular units of FIG. 3 in the retracted position of FIG. 2.

The first side 41 of the primary cell 24 is defined by an upper sidewall portion 42 and a lower sidewall portion 61 divided by an outer pleat or crease 44, which for convenience purposes is generally referred to as a first crease 44 in this disclosure. The first side 41 generally resembles a right curly brace or bracket that opens towards the inner volume 63 of the primary cell 24. The first crease 44 is an outer creases in that the apex of the first crease 44 is directed outward and away from an inner volume 63 of the primary cell 24. The first crease 44 extends along the entire length of the primary cell 24. The first crease 44 acts as a bend or fold point for the primary cell 24 and when the cellular panel 16 is retracted, the primary cell 24 collapses at the crease 44. For example, as shown in FIG. 4, when the cellular units 22 are collapsed, the primary cell 24 bends at the first crease 44. This allows the primary cell 24 to collapse at a predicted location, as well as provide for uniform extending and retracting of the cellular panel 16. The first crease 44 may be located at approximately a midpoint of the height of the primary cell 24 so that the upper sidewall portion 42 and the lower sidewall portion 61 have equal heights.

The upper sidewall portion 42 of the primary cell 24 extends between the top 30 of the cell 24 and the first crease 44. The upper sidewall portion 42 may have a generally arcuate or curved shape, may be generally linear, or both. The upper sidewall portion 42 may include concave segments, convex segments, or both. For example, relative to an inner volume 63 of the primary cell 24, the upper sidewall portion 42 shown in FIG. 3 includes a concave inward segment extending downward and outward from the top 30 of the cell 24. The concave inward segment is positioned above a convex inward segment that terminates at first crease 44. If the upper sidewall portion 42 includes altering curvatures or concavity, an inflection point between the curvature or concavity changes may be positioned at various heights between the top 30 and the first crease 44 of the cell 24, including a midpoint of the height of the upper sidewall portion 42. Additionally or alternatively, a generally linear section may be positioned integrally between, above, and/or below the generally arcuate or curved segments. The upper sidewall portion 42 transitions into the first crease 44, which delineates the lower sidewall portion 61 from the upper sidewall portion 42.

The lower sidewall portion 61 of the primary cell 24 extends between the first crease 44 and the bottom 40 of the cell 24. Similar to the upper sidewall portion 42, the lower sidewall portion 61 may have a generally arcuate or curved shape, may be generally linear, or both. In addition, the lower sidewall portion 61 may include concave segments, convex segments, or both. For example, relative to an inner volume 63 of the primary cell 24, the lower sidewall portion 61 shown in FIG. 3 includes a convex inward segment extending downward and inward from the first crease 44 of the cell 24. The convex inward segment is positioned above a concave inward segment that terminates at the bottom 40 of the cell 24. If the lower sidewall portion 61 includes altering curvatures or concavity, an inflection point between the curvature or concavity changes may be positioned at various heights between the bottom 40 and the first crease 44, including a midpoint of the height of the lower sidewall portion 61. Additionally or alternatively, a generally linear section may be positioned integrally between, above, and/or below the generally arcuate or curved segments.

The second side 43 of the primary cell 24 is defined by a plurality of sidewall portions divided by a plurality of creases. Although various numbers of sidewall portions and creases are contemplated, the second side 43 shown in FIG. 3 includes four sidewall portions divided by three creases. For convenience purposes, the four sidewall portions are referred to herein as a first upper sidewall portion 54, a second upper sidewall portion 53, a first lower sidewall portion 47, and a second lower sidewall portion 46. In addition, for convenience purposes, the three creases are referred to herein as a second crease 52, a third crease 50, and a fourth crease 48. The second crease 52, the third crease 50, and the fourth crease 48 extend along the entire length of the primary cell 24. The creases 52, 50, 48 each act as bend or fold point for the primary cell 24 and when the cellular panel 16 is retracted, the primary cell 24 collapses at each of the creases 52, 50, 48. For example, as shown in FIG. 4, when the cellular units 22 are collapsed, the primary cell 24 bends at the second crease 52, the third crease 50, and the fourth crease 48. This allows the primary cell 24 to collapse at predicted locations, as well as provide for uniform extending and retracting of the cellular panel 16.

The first upper sidewall portion 54 and the second upper sidewall portion 53 are divided by the second crease 52, which is an outer crease in that the apex of the crease 52 is directed outward and away from the inner volume 63 of the primary cell 24. The second crease 52 is located at a cell height location above the first crease 44 on the first side 41 of the primary cell 24. In other words, the length of the first sidewall 42 prior to the first crease 44 may be longer than the length of the upper second sidewall 54 prior to the second crease 52. The second crease 52 may be located at approximately a midpoint of the aggregate height of the first and second upper sidewall portions 54, 53 so that the upper sidewall portions 54, 53 have equal heights. In other words, the second crease 52 may be located vertically equidistant between the top 30 of the cell 24 and the third crease 50. Additionally or alternatively, the combined height of the first and second upper sidewall portions 54, 53 may be coextensive in height with the upper sidewall portion 42 of the first side 41 of the primary cell 24. Thus, in some implementations, the second crease 52 may be vertically positioned at a midpoint height of the upper sidewall portion 42, while being laterally separated from the sidewall portion 42 by the inner volume 63 of the primary cell 24. In other words, the second crease 52 may be located vertically equidistant between the top 30 of the cell 24 and the first crease 44.

The first upper sidewall portion 54 of the second side 43 of the primary cell 24 extends between the top 30 of the cell 24 and the second crease 52. The first upper sidewall portion 54 may have a generally arcuate or curved shape, may be generally linear, or both. For example, the first upper sidewall portion 54 shown in FIG. 3 includes an arcuate or curved segment extending downward and outward from the top 30 of the cell 24. The arcuate or curved segment generally forms a concave inward shape relative to the inner volume 63 of the primary cell 24. A lower end of the arcuate or curved segment transitions into a linear segment that terminates at the second crease 52. From the top 30 of the primary cell 24, the first upper sidewall portion 54 and the upper sidewall portion 42 diverge from each other so that the inner volume 63 of the primary cell 24 increases in depth from the top 30 of the cell 24 to the second crease 52, which delineates the first upper sidewall portion 54 from the second upper sidewall portion 53.

The second upper sidewall portion 53 of the second side 43 of the primary cell 24 extends between the second crease 52 and the third crease 50. Similar to the first upper sidewall portion 54, the second upper sidewall portion 53 may have a generally arcuate or curved shape, may be generally linear, or both. For example, the second upper sidewall portion 53 shown in FIG. 3 includes a linear segment extending downward and inward from the second crease 52. A lower end of the linear segment transitions into an arcuate or curved segment that terminates at the third crease 50. The arcuate or curved segment generally forms a concave inward shape relative to the inner volume 63 of the primary cell 24. From a cell height location coextensive with the height of the second crease 52, the second upper sidewall portion 53 and the upper sidewall portion 42 both extend downward toward a room side of the covering 10. The second upper sidewall portion 53 generally extends downward at a less severe curvature or slope than the upper sidewall portion 42 so that the inner volume 63 of the primary cell 24 decreases in depth from the second crease 52 to the third crease 50.

The third crease 50 divides the second upper sidewall portion 53 and the first lower sidewall portion 47. The third crease 50 is an inner crease in that the apex of the third crease 50 is directed inward toward the inner volume 63 of the primary cell 24. The third crease 50 may be located at approximately a midpoint of the height of the primary cell 24 so that the combined height of the first and second upper sidewall portions 54, 53 is approximately equal to the combined height of the first and second lower sidewall portions 47, 46. In other words, the third crease 50 may be located vertically equidistant between the top 30 and the bottom 40 of the cell 24. Additionally or alternatively, the third crease 50 may be coextensive in height with the first crease 44, while being laterally separated from the first crease 44. In some implementations, the first crease 44 and the third crease 50 are vertically aligned or coplanar so that a horizontal plane passing through the creases 44, 50 divides the inner volume 63 of the primary cell 24 into an upper and lower cavity having equal volumes. The third crease 50 may be positioned so that the crease 50 is approximately laterally aligned with the longitudinal edge 28 of the second side 43 of the primary cell 24. Adhesive 56 may be associated with the third crease 50 to assist in maintaining the shape of the second side 43 of the primary cell 24 when the cellular panel 16 is extended. For example, the adhesive 56 may substantially prevent the second and fourth creases 52, 48 from stretching, as the adhesive 56 maintains the shape of the third crease 50. The adhesive 56 may also increase the resiliency of the primary cell 24. Although the second upper sidewall portion 53 and the first lower sidewall portion 47 are depicted as integrally connected at the third crease 50, the sidewall portions 53, 47 may be formed as separate pieces and operably connected together at the third crease 50 location by the adhesive 56. Additionally or alternatively, other suitable fastening methods, such as stitching, may be used.

The first lower sidewall portion 47 and the second lower sidewall portion 46 are divided by the fourth crease 48, which is an outer crease in that the apex of the crease 48 is directed outward and away from the inner volume 63 of the primary cell 24. The fourth crease 48 may be located at approximately a midpoint of the aggregate height of the first and second lower sidewall portions 47, 46 so that the lower sidewall portions 47, 46 have equal heights. In other words, the fourth crease 48 may be located vertically equidistant between the third crease 50 and the bottom 40 of the cell 24. Additionally or alternatively, the combined height of the first and second lower sidewall portions 47, 46 may be coextensive in height with the lower sidewall portion 61 of the first side 41 of the primary cell 24. Thus, in some implementations, the fourth crease 48 may be vertically positioned at a midpoint height of the lower sidewall portion 61 while being laterally separated from the sidewall portion 61 by the inner volume 63 of the primary cell 24. In other words, the fourth crease 48 may be located vertically equidistant between the first crease 44 and the bottom 40 of the cell 24.

The first lower sidewall portion 47 of the second side 43 of the primary cell 24 extends between the third crease 50 and the fourth crease 48. The first lower sidewall portion 47 may have a generally arcuate or curved shape, may be generally linear, or both. For example, the first upper sidewall portion 47 shown in FIG. 3 includes an arcuate or curved segment extending downward and outward from the third crease 50 of the cell 24. The arcuate or curved segment generally forms a concave inward shape relative to the inner volume 63 of the primary cell 24. A lower end of the arcuate or curved segment transitions into a linear segment that terminates at the fourth crease 48. From the third crease 50 of the primary cell 24, the first lower sidewall portion 47 and the lower sidewall portion 61 both extend downward toward a road side of the covering 10. The first lower sidewall portion 47 generally extends downward at a less severe curvature or slope than the lower sidewall portion 61 so that the inner volume 63 of the primary cell 24 increases in depth from the third crease 50 to the fourth crease 48, which delineates the first lower sidewall portion 47 from the second lower sidewall portion 46.

The second lower sidewall portion 46 of the second side 43 of the primary cell 24 extends between the fourth crease 48 and the bottom 40 of the cell 24. Similar to the first lower sidewall portion 54, the second lower sidewall portion 46 may have a generally arcuate or curved shape, may be generally linear, or both. For example, the second lower sidewall portion 46 shown in FIG. 3 includes a linear segment extending downward and inward from the fourth crease 48. A lower end of the linear segment transitions into an arcuate or curved segment that terminates at the bottom 40 of the primary cell 24. The arcuate or curved segment generally forms a concave inward shape relative to the inner volume 63 of the primary cell 24. From a cell height location coextensive with the height of the fourth crease 48, the second lower sidewall portion 46 and the lower sidewall portion 61 converge toward each other so that the inner volume 63 of the primary cell 24 decreases in depth from the fourth crease 48 to the bottom 40 of the cell 24. Thus, in one implementation, as illustrated in FIG. 3, the primary cell 24, when extended, may increase in depth from a top 30 of the cell 24 to a second crease 52, may decrease in depth from the second crease 52 to a third crease 50, may increase in depth from the third crease 50 to a fourth crease 48, and may decrease in depth from the fourth crease 48 to a bottom 40 of the cell 24.

In one example, the first upper sidewall portion 54 and the second upper sidewall portion 53 may form a "V" or "U" shape depending on the angle of the sidewall portions 54, 53 as they extend away from the second crease 52. The apex or tip of the "V" or the bottom of the "U" is directed outward, away from the cell 24. Similarly, the first lower sidewall portion 47 and the second lower sidewall portion 46 may form a "V" or "U" shape, and the apex or tip of the "V" or the bottom of the "U" may be directed outward, away from the cell 24. Thus, the second side 43 may generally resemble a "W" shape, with the bottom tips of the "W" being the second crease 52 and the fourth crease 48. The bottom tips of the "W" may point towards a road side of the covering 10. It should be noted that in some implementations, the angles of the sidewall portions 46, 47, 53, 54 transitioning into the creases 48, 50, 52 may be significantly increased from the retracted position of the cellular panel 16 to the extended position of the cellular panel 16. Thus, the "W" or "V" shapes may be altered based on the particular position of the cellular panel 16. Furthermore, in some instances, the second sidewalls 46, 47, 53, 54 may have a curved or arcuate shape, and thus may form different shapes transitioning between each crease 48, 50, 52.

As explained above relative to FIG. 3, in one implementation the primary cell 24 has four creases, the first crease 44 on the first side 41 and the second crease 52, the third crease 50, and the fourth crease 48 located on the second side 43. The first crease 44, the second crease 52 and the fourth crease 48 are outer creases in that the apex of each crease is directed outward and away from an inner portion of the primary cell 24. On the other hand, the third crease 50 is an inner crease in that its apex is directed towards an inner portion of the primary cell 24. Each of the creases 44, 48, 50, 52 act as bending or folding points for the primary cell 24. As described above with respect to the first crease 44, the creases 44, 48, 50, 52 allow the primary cell 24 to collapse at the particular location, as well as maintain a resiliency when the cellular panel 16 is extended. The apexes of the first and third creases 44, 50 both point towards a room side of the covering 10, whereas the apexes of the second and fourth creases 52, 48 both point towards a road side of the covering 10. In one implementation, the third crease 50 is generally aligned with the first crease 44, and the second and fourth creases 52, 48 split the height of the primary cell 24 above and below the first crease 44, respectively.

Furthermore, the third or inner crease 50 provides an additional bend point for the primary cell 24, and in the retracted position (FIG. 4) allows for the second upper sidewall portion 53 to rest adjacent the first lower sidewall portion 47. The third crease 50 provides for the second side 43 of the primary cell 24 to have approximately the same amount of material as the first side 41, but have a shorter depth than the first side 41 when folded. Referring briefly to FIG. 4, in these examples, the first side 41 may have a depth D1 (as measured from the two longitudinal edges 28, 29) that is approximately double a depth D2 of the second side 43. In this manner, the cellular panel 16 may be positioned in low-depth architectural openings.

With reference to FIGS. 3 and 4, the second side 43 of the primary cell 24 has approximately the same height of the first side 41 when the cellular panel 16 is extended. Additionally, the stacked or retracted height or thickness T1 of the first side 41 may be approximately the same as the stacked height or thickness T2 of the second side 43.

Although only the third crease 50 is indicated as being held in place via adhesive 56, in other implementations other creases may also be held in place via adhesive. This may allow the outer creases 44, 48, 52 to retain their structure and shape when the cellular panel 16 is extended. However, in other implementations, only the inner crease 50 may be secured via adhesive 56 as the drop of the primary cell 24 may be affected by the inner crease 50 because too much adhesive 56 at the inner crease 50 restricts the crease 50 from fully expanding when dropped or extended.

The "W" shape or the double pleated shape of the primary cell 24 due to the creases 44, 48, 50, 52 allows for the primary cell 24 to have an increased drop ratio. The drop ratio may be determined by the length of the primary cell 24 (or drop) divided by the width of the strip of material used to form the primary cell 24. In some examples, the drop ratio may range from 0.20 to 0.30 depending on various cell widths and so on.

In a specific example, the drop of the primary cell 24 may be approximately 3.25 inches while the perimeter of the primary cell 24, and thus the overall length or width of the strip of material forming the primary cell 24, may be approximately 11.812 inches. In this example, the drop ratio may be approximately 0.275. This drop ratio may be increased as compared to a similar cellular covering having only a single pleat or crease on each side. The better drop ratio may allow the panel 16 to be manufactured using less fabric to cover the same depth of an architectural opening as well as the same length of the architectural opening.

Figure 3A:
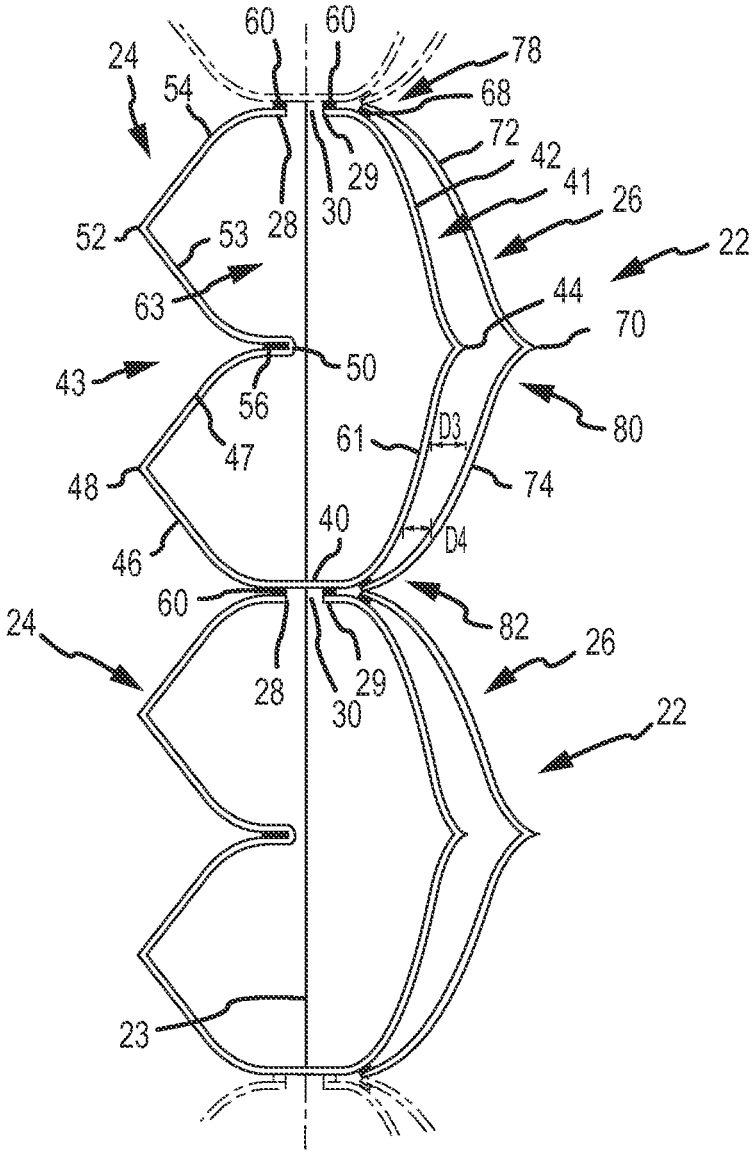
FIG. 3A is an alternative side elevation view of the covering with a lift cord extending along or near a vertical centerline of the covering.

In some implementations, the lift cord 23, which may be integrally connected to the control cord 23, may be operably connected to the cellular unit 22 via the primary cell 24. For example, the lift cord 23 may be threaded through an aperture 49 in the adhesive 60 operably connecting adjacent cellular units 22 and through an aperture 49 in the adhesive 56 positioned within the inner crease 50. In this manner, the lift cord 23 can stack and extend the cellular unit 22, and the adhesive 56, 60 may be more rigid than the material of the primary cell 24. Thus, the lift cord 23 may be less likely to tear or rip through the cellular unit 22 if the panel 16 was to be pulled substantially orthogonally to a longitudinal axis of the lift cord 23 (e.g., if the panel 16 covers an open window and a wind gust pulls the panel 16 in a particular direction). It should be noted that, although it may be advantageous to place the lift cord 23 through an aperture 49 in the adhesive 56, in some implementations the lift cord 23 does not extend through the adhesive 56. In some implementations, the lift cord 23 is substantially co-linear with a centerline of the cellular unit 22 and extends through the top 30 and the bottom 40 of the cell 24 laterally equidistant between the lines of adhesive 60, as shown in FIG. 3A. In FIG. 3A, it is also contemplated that the lift cord may extend adjacent to or near the centerline of the cellular unit 22. In these implementations, an aperture 49 associated with the third crease 50 of each cell 24 may be co-linear with the centerline so that the lift cord 23 passes through the third crease 50 along the centerline of the cellular unit 22. Additionally or alternatively, the aperture 49 associated with the longitudinal edge 28 or 29 of the top 30 of the cell 24 may be co-linear with the centerline.

The Secondary Cell

Referring to FIG. 3 and FIG. 4, each cellular unit 22 may also include a secondary or outer cell 26. The secondary cell 26 is formed by connecting a top edge of an outer wall 80 or sheet of material to a front top surface of the primary cell 24 and a bottom edge of the outer wall 80 to a front bottom surface of the primary cell 24. In some instances, the outer wall 80 is connected to the primary cell 24 adjacent to the adhesive 60 connecting each cellular unit 22 to the next cellular unit 22. In other examples, the outer wall 80 may be connected lower on the front face of the first sidewall 42 than the adhesive 60. The primary cell 24 may be exposed above or below the secondary cell 26 depending on the location of the attachment of the upper and lower edges of the outer wall 80. Thus, in some examples, the secondary cell 26 only partially covers the primary cell 24 in the height dimension.

In one example, the outer wall 80 attaches to the primary cell 24 via adhesive 68 positioned on an outer surface of the top 30 of the primary cell 24. The adhesive 68 (and thus the connection location of the outer wall 80) may be adjacent to the adhesive 60 connecting the longitudinal edges 28, 29 to the adjacent primary cell. In other examples, the outer wall 80 may be connected to the primary cell 24 at the connection location of the longitudinal edges 28, 29.

From the connection location to the primary cell 24, the outer wall 80 transitions downward and outward to form an upper sidewall 72. The upper sidewall 72 then extends and is folded or pleated at crease 70. The crease 70 may be formed longitudinally across the front face of the sidewall 72 and may extend across the entire width of the cellular panel 16. After the crease 70, the outer wall 80 transitions to a lower sidewall 74, which is connected to an outer surface of the bottom 40 of the primary cell 24 via adhesive 68.

The outer wall 80 may generally conform to or be generally coextensive with the shape of the first side 41 of the primary cell 24. For example, as shown in FIG. 3, the outer wall 80 generally resembles a right curly brace or bracket that opens towards the first side 41 of the primary cell 24. The outer wall 80 may be formed of a material that generally conforms to the shape of the first side 41 of the primary cell 24 and may completely or substantially cover the first side 41 of the primary cell 24.

The outer wall 80 is spaced apart from the first side 41 of the primary cell 24 along the height of the first side 41 to form the second insulative cell 26. The spacing between the outer wall 80 and the first side 41 increases from the edges toward the center of the outer wall 80. In other words, the depth of the secondary cell 26 increases from the top and bottom of the cell 26 toward the center of the cell 26. For example, as shown in FIG. 3, the depth D3 is greater than the depth D4. For example, the crease 70 of the outer wall 80 may be at substantially the same height location with respect to the cellular unit 22 as the crease 44 in the primary cell 24.

The crease 70 of the outer wall 70 may be vertically coextensive with the crease 44 of the first side 41 of the primary cell 24. In other words, the crease 70 may be aligned with the crease 44 so that a horizontal plane passes through an apex of each of the creases 70, 44. As previously discussed, the outer wall 80 may be laterally spaced apart from the first side 41 of the primary cell 24 so that the outer wall 80 extends further outward toward the room side of the covering 10 than the primary cell 24. In this configuration, the outer wall 80 and the first side 41 create a pocket that may trap air to provide insulation for the cellular panel 16.

When connected to the primary cell 24, the outer wall 80 forms the secondary cell 26. The secondary cell 26 may have a first side defined by the outer wall 80, a second side defined by the first side 41 of the primary cell 24, a top 78, and a bottom 82. The top 78 and the bottom 82 may be defined by the adhesive 68. In some examples, the secondary cell 26 may have a substantially smaller volume than the primary cell 24. Although the secondary cell 26 may have a smaller volume, the secondary cell 26 may still provide insulation and increase the R value of the cellular panel 16.

Additionally, in the examples where the outer wall 80 may completely or partially cover the first side 41 of the primary cell 24, the primary cell 24 may be substantially hidden from view from a particular side of the cellular panel 16. For example, the side of the panel 16 including the outer wall 80 may be positioned towards the room and away from the architectural opening. In these examples, the material for forming the primary cell 24 may be a lower quality, less aesthetically pleasing, or a less expensive material than the outer wall 80, as the material of the primary cell 24 may be hidden. The outer wall 80 may be formed of substantially any material, such as but not limited to, woven, non-woven, knits, fabrics, or sheets of manmade or natural material. The outer wall 80 of the secondary cell 26 may be made of relatively expensive material, such as but not limited to rich, texturized, or embossed fabric. This may allow for the cellular panel 16 to be manufactured less expensively, while still maintaining an aesthetically pleasing appearance and an appearance of higher quality materials.

Furthermore, in examples where the primary cell 24 may be a blackout material or may include a blackout layer or be a dark color, the outer wall 80 may reduce a potential color distortion. For example, if the primary cell 24 includes a blackout layer on its inner surface on sidewalls 46, 47, 53, 54, the first outer sidewall 42, 61 (if a lighter color) may appear grey or discolored due to the black or dark layer showing through. However, when the outer wall 80 is placed coextensively with the outer sidewalls 42, 61 only the desired color of the outer wall 80 may be visible.

The overall shape of the outer wall 80, the secondary cell 26, and the primary cell 24 is aesthetically pleasing and enhances a visual experience of the user. For example, the longer height dimension of the outer wall 80 forming the outer cell 26, which faces the room side of the covering 10, provides a typically more pleasing aspect ratio than the more closely-spaced pleats of the second side 43 of the primary cell 24, which faces the road side of the covering 10. While certain elements of the cellular structure are functional, the combination of elements and some sub-combinations are also distinctive and provide a unique aesthetic appearance.

Referring again to FIG. 4, the outer wall 80 may also balance the thickness T1 of the first side 41 of the primary cell 24 and the outer wall 80 with the thickness T2 of the second side 43 of the primary cell 24. Thus, the thickness T2 of the multiple creases 48, 50, 52 is balanced against the single crease 44 of the first side 44 by the outer wall 80. As the thickness T1 and T2 are substantially equal, the cellular panel 16 may more easily stack when retracted, although the depths D1, D2 may not be equal to one another.

Figure 5:
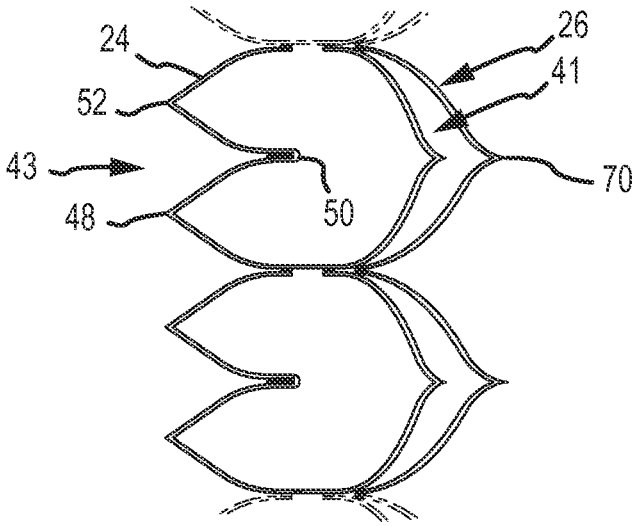
FIG. 5 is an enlarged side elevation view of another example of a cellular unit.
Figure 6:
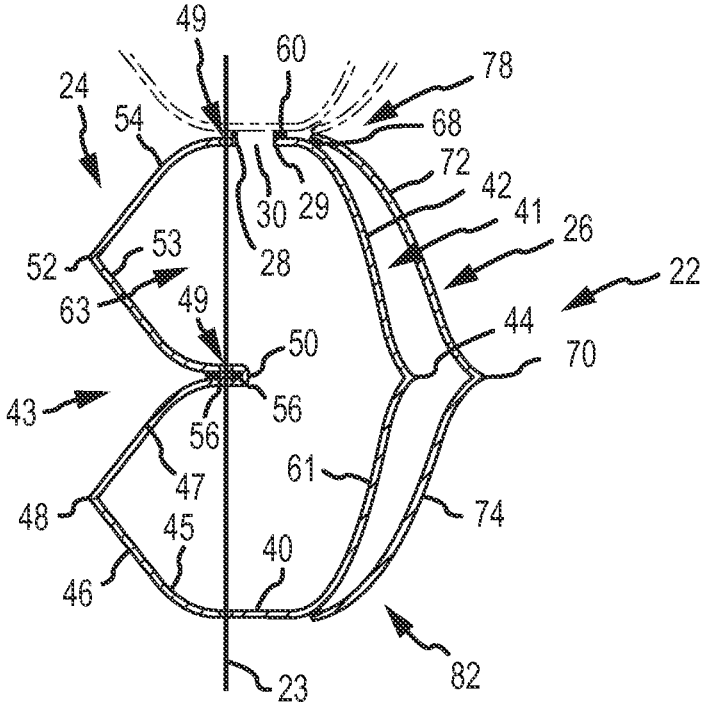
FIG. 6 is an enlarged cross-section view of the cellular unit of FIG. 1 taken along the line 6-6 as shown in FIG. 1.
Figure 7:
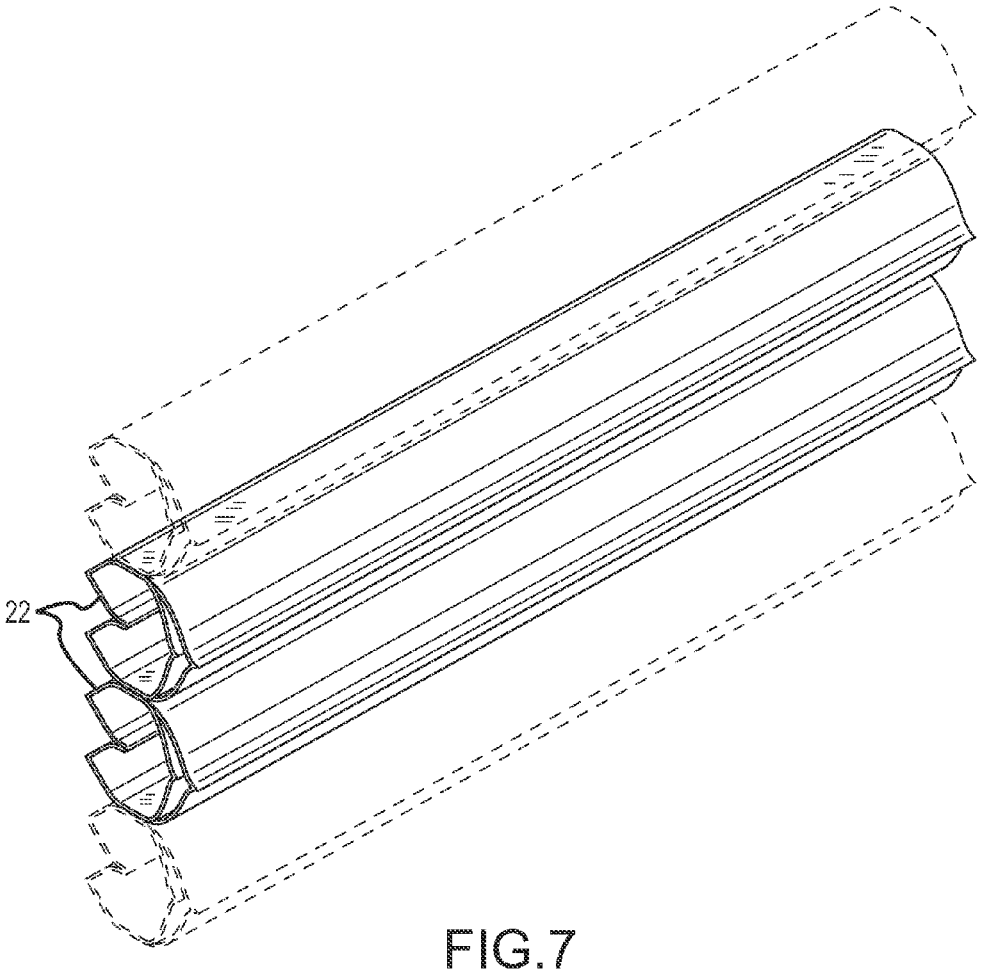
FIG. 7 is an isometric view of two cellular units removed from the panel of FIG. 1.
Figure 8:
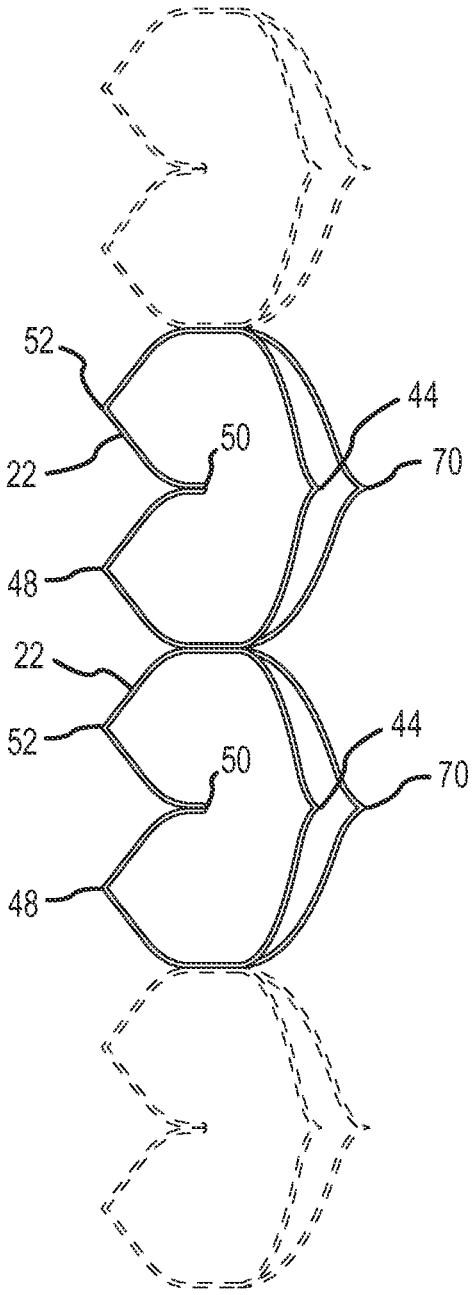
FIG. 8 is a side elevation view of the two cellular units of FIG. 7.
Figure 9:
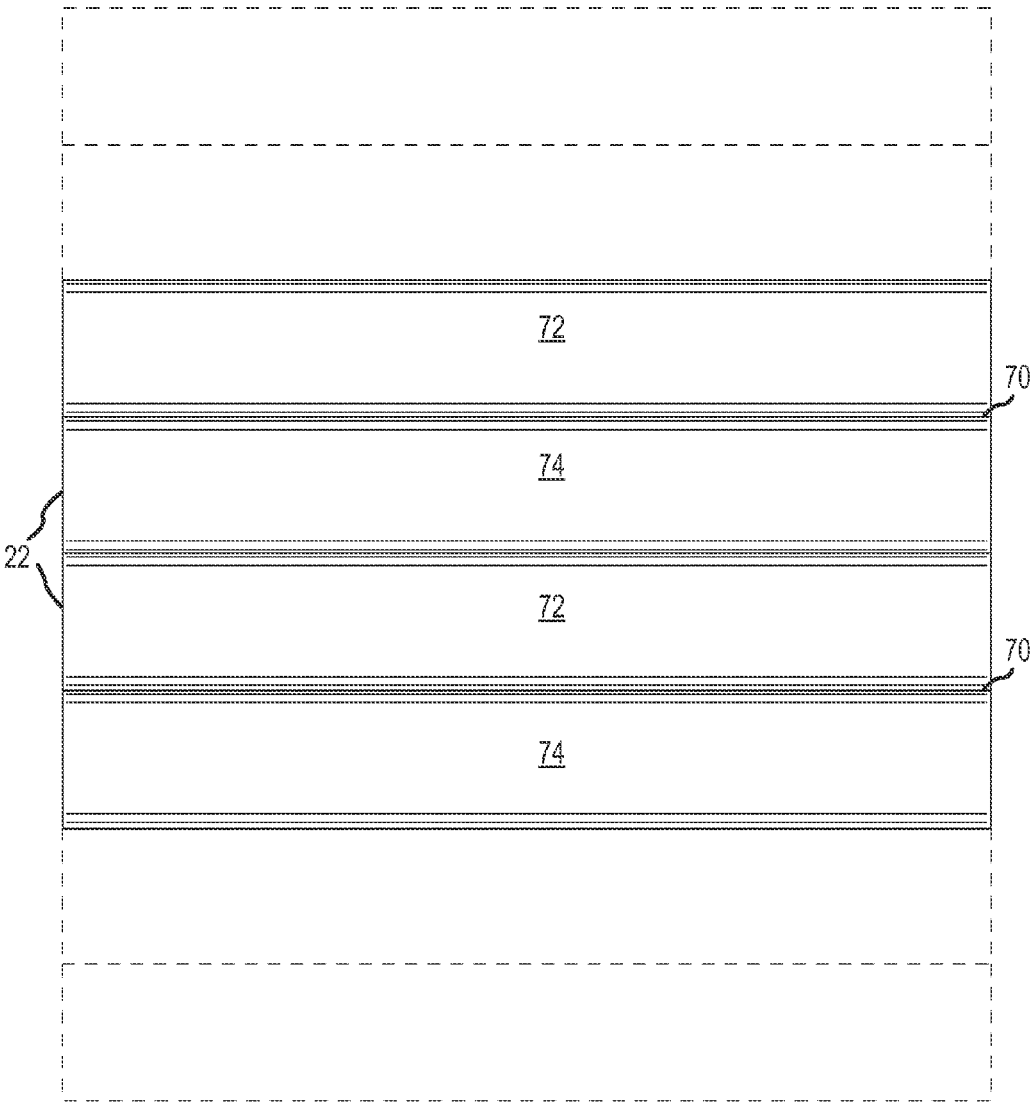
FIG. 9 is a front elevation view of the two cellular units of FIG. 7.
Figure 10:
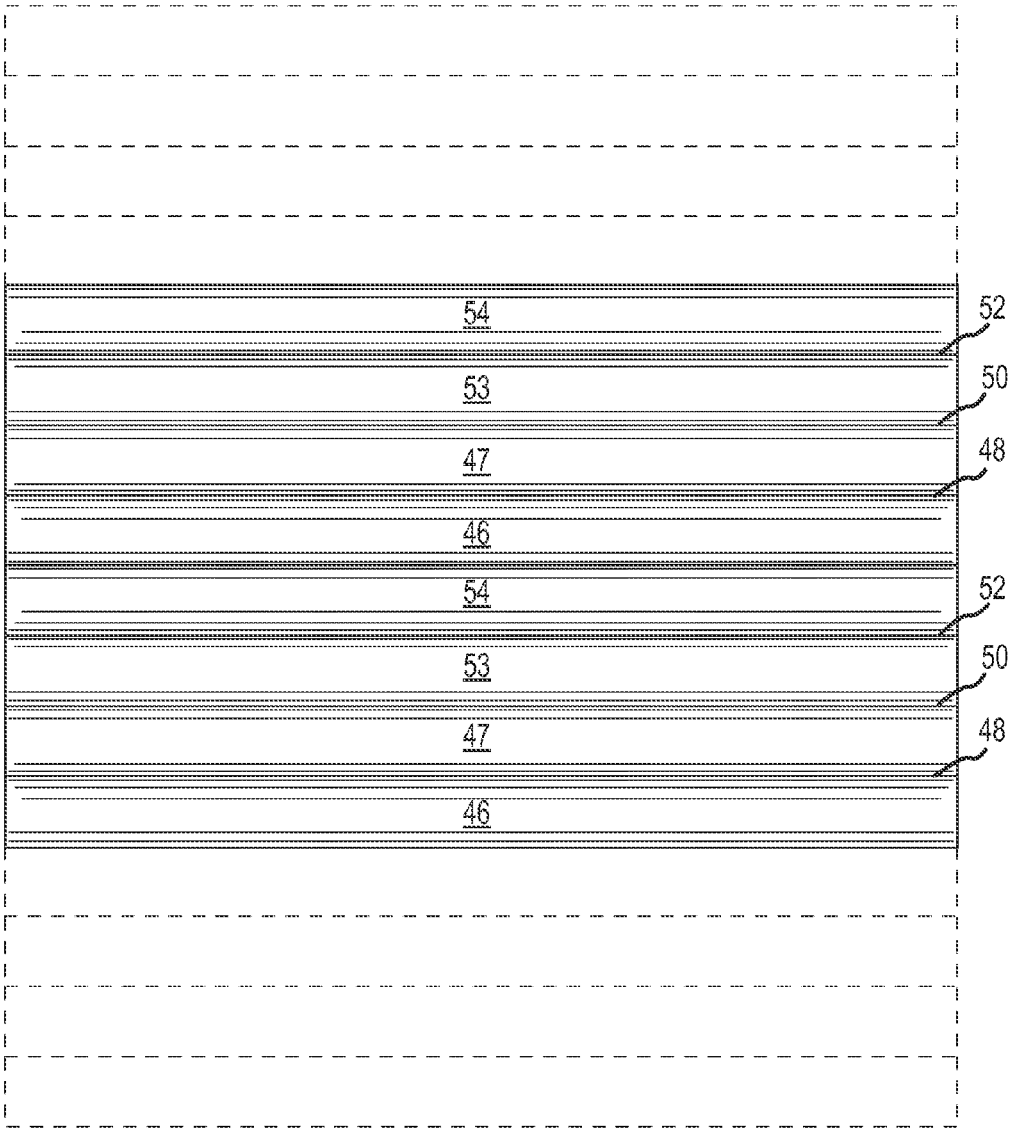
FIG. 10 is a rear elevation view of the two cellular units of FIG. 7.
Figure 11:
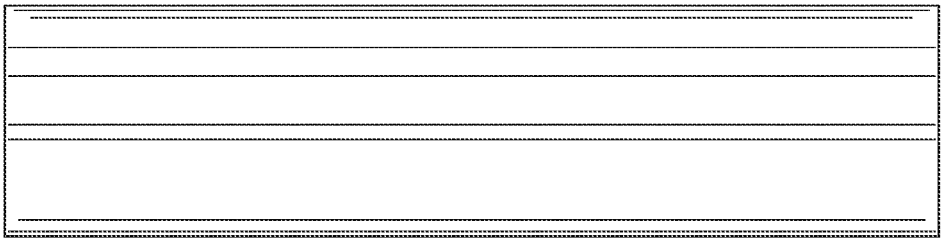
FIG. 11 is a bottom plan view of the two cellular units of FIG. 7.
Figure 12:
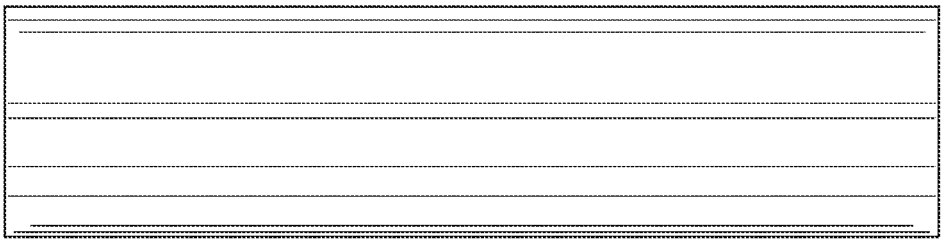
FIG. 12 is a top plan view of the two cellular units of FIG. 7.

FIG. 5 is an enlarged view of an alternative example of the cellular unit 22. As shown in FIG. 5, in some examples, the primary cell 24 and the secondary cell 26 may have smaller dimensions. In these examples, the structure may be substantially the same as the cellular unit illustrated in FIG. 3. However, the angles between the creases 44, 48, 50, 52, 70 may be smaller. Additionally, the other dimensions may be altered as well, affecting the drop ratio.

In one example of the cellular panel 16 of FIG. 5, the drop of the primary cell 24 may be approximately 1.312 inches, the width may be approximately 5.315 inches and the drop ratio may be approximately 0.247. In another example, the drop of the primary cell 24 may be approximately 2.1 inches and the width of the material may be approximately 10.025 inches, leading to a drop ratio of approximately 0.209.

Figure 13A:
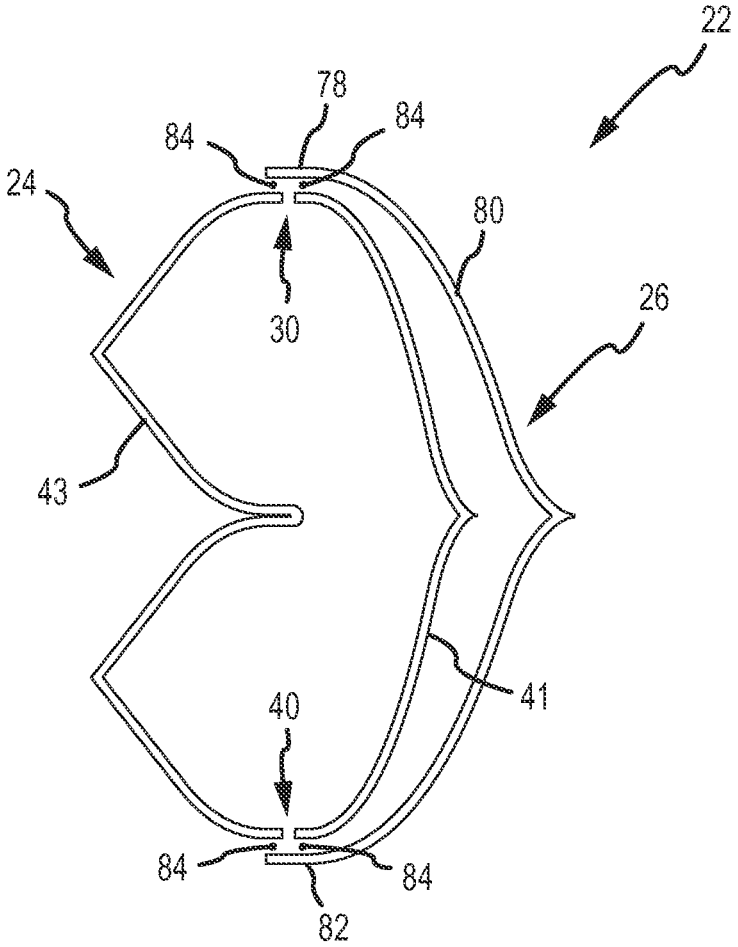
FIG. 13A is an enlarged exploded side elevation view of an example cellular unit.
Figure 13B:
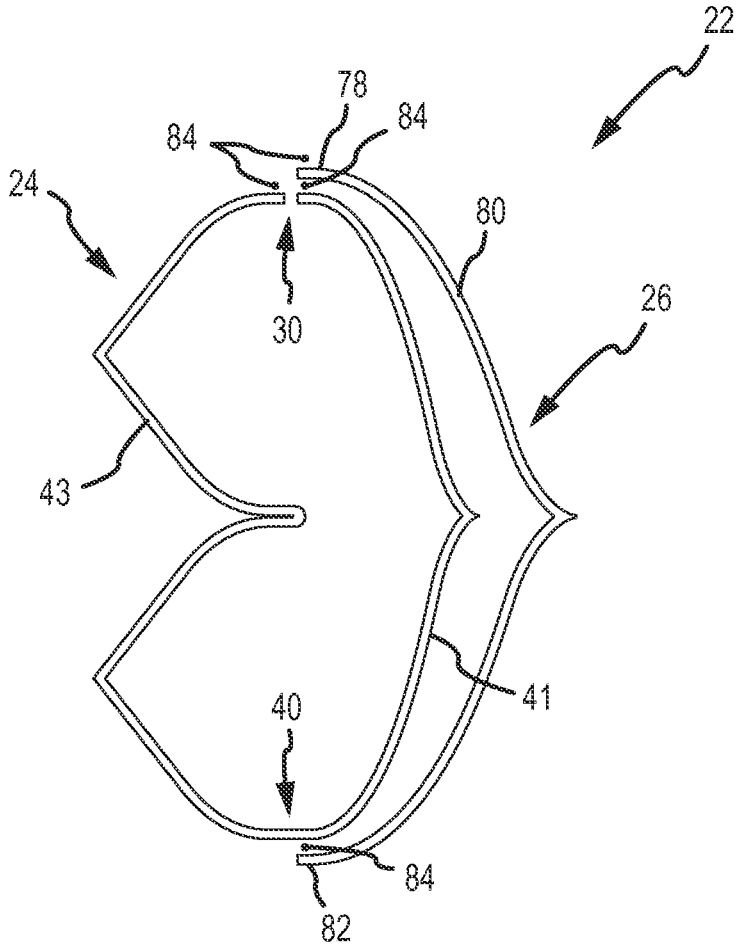
FIG. 13B is an enlarged exploded side elevation view of another example cellular unit.
Figure 13C:
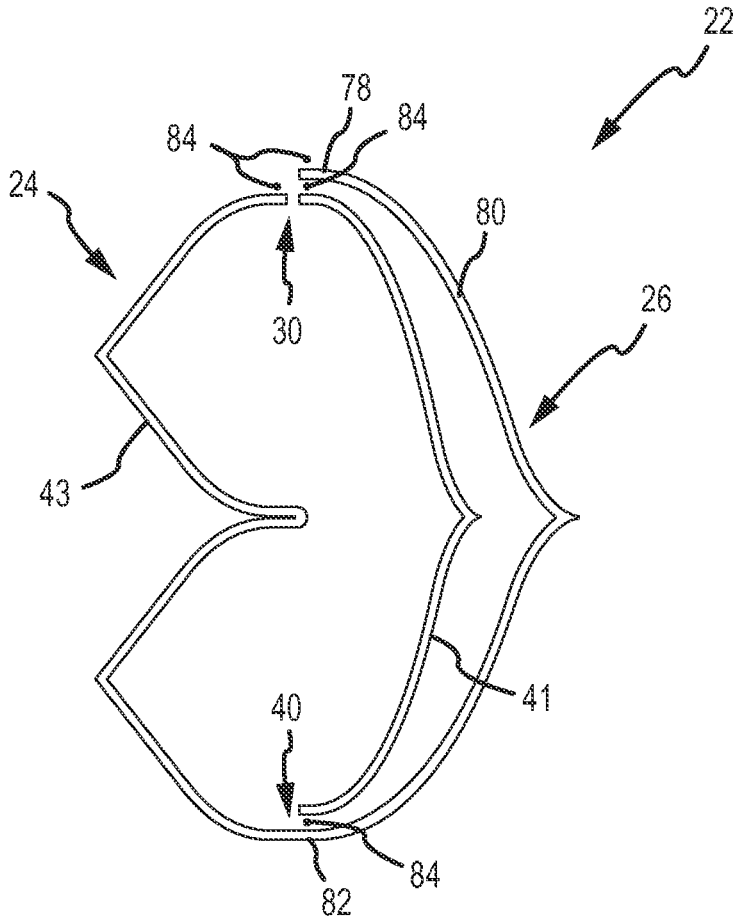
FIG. 13C is an enlarged exploded side elevation view of yet another example cellular unit.

Referring to FIGS. 13A-13C, exploded views of three configurations of cellular units 22 are provided. The cellular units 22 depicted in FIGS. 13A-13C have approximately the same shape and features as those previously described in relation to FIGS. 1-12. For example, the cellular unit 22 in FIGS. 13A-13C has a primary cell 24 and a secondary cell 26. The primary cell 24 is formed by a first side 41, a second side 43, a top 30, and a bottom 40. The secondary cell 26 is formed by the first side 41, an outer wall 80, a top 78, and a bottom 82.

As illustrated in FIGS. 13A-13C, despite having similar shape and features, the cellular units 22 are formed in three different material configurations. In FIG. 13A, the first side 41, the second side 43, and the outer wall 80 are formed individually from three separate pieces or strips of material. The first side 41, the second side 43, and the outer wall 80 may each be constructed from the same type of material, different types of materials, or a combination thereof. For example, in one example, the second side 43 is an inexpensive, light permeable material, the first side 41 is a blackout material, and the outer wall 80 is an expensive, aesthetically pleasing material. As another example, the second side 43 is a blackout material, the first side 41 is an inexpensive, light permeable material, and the outer wall 80 is an expensive, aesthetically pleasing material. As a further example, the second side 43, the first side 41, and the outer wall 80 are all formed from a blackout material. In FIG. 13A, a top 78 of the outer wall 80 connects to the discontinuous top 30 of the primary cell 24 via an adhesive 84 or other suitable fastener. Similarly, a bottom 82 of the outer wall 80 connects to the discontinuous bottom 40 of the primary cell 24 via an adhesive 84 or other suitable fastener. In one example, the outer wall 80 connects to both the first side 41 and the second side 43 at the top 30 and the bottom 40 of the primary cell 24.

Referring to FIG. 13B, the first side 41 and the second side 43 of the cellular unit 22 are formed from a single, continuous piece or strip of material, and the outer wall 80 is formed from a separate piece or strip of material. Thus, the first side 41 and the second side 43 are constructed of the same type of material, and the outer wall 80 may be formed from the same, or a different, type of material as compared to the first and second sides 41, 43. In FIG. 13B, a top 78 of the outer wall 80 connects to the discontinuous top 30 of the primary cell 24 via an adhesive 84 or other suitable fastener, and a bottom 82 of the outer wall 80 connects to the continuous bottom 40 of the primary cell 24 via an adhesive 84 or other suitable fastener. In one example, the outer wall 80 connects to both the first and second sides 41, 43 at the top 30 of the primary cell 24.

Referring to FIG. 13C, the second side 43 and the outer wall 80 are formed from a single, continuous piece or strip of material, and the first side 41 is formed from a separate piece or strip of material. Thus, the second side 43 and the outer wall 80 are constructed of the same type of material, and the first side 41 may be formed from the same, or a different, type of material as compared to the second side 43 and the outer wall 80. In FIG. 13C, the first side 41 fits within an interior space defined by the second side 43 and the outer wall 80. The first side 41 divides the interior space into the primary cell 24 and the secondary cell 26.

Conclusion

The foregoing description has broad application. For example, while examples disclosed herein may focus on the particular drop ratio, shapes, and widths of the cellular panel, it should be appreciated that the concepts disclosed herein may equally apply to other dimensions, shapes, and widths. In one specific example, the cellular panel fits between glass panes in a window, door, or other suitable building component. Similarly, although the cellular unit and the outer wall have been discussed as being formed in a particular manner, the devices and techniques are equally applicable to embodiments using other forming techniques. For example, although adhesive has been discussed in relation to connecting various features of the cellular panel 16, sewing or other types of fastening the various features together may be used unless specifically excluded or not suitable for the intended purpose. Accordingly, the discussion of any embodiment is meant only to be explanatory and is not intended to suggest that the scope of the disclosure, including the claims, is limited to these examples.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The drawings are for purposes of illustration only and the dimensions, positions, order and relative sizes reflected in the drawings attached hereto may vary.

What is claimed is:

1. A covering for an architectural opening, comprising:
a head rail;
an end rail; and
a cellular panel operably connected between the head rail and the end rail, the cellular panel including at least one cellular unit, each cellular unit comprising:
a primary cell including:
a top;
a bottom;
a first side extending between the top and the bottom, the first side having a first crease; and
a second side extending between the top and the bottom, the second side having a second crease, wherein:
the top, the bottom, the first side, and the second side define a continuous inner volume of the primary cell;
an outermost portion of the second side is disposed between the top and the bottom of the primary cell;
the first crease is an outer crease having an apex directed away from the inner volume of the primary cell;
the second crease is an inner crease having an apex directed toward the inner volume of the primary cell; and
the first and second creases are defined in or adiacent to opposing sides of the cellular panel.

2. The covering of claim 1, wherein the second crease is aligned with the first crease.

3. The covering of claim 1, wherein each cellular unit further comprises an outer wall connected to an outer top surface and an outer bottom surface of the first side of the primary cell to form a secondary cell disposed laterally adjacent to the primary cell, the outer wall having a crease aligned with the first crease of the primary cell.

4. The covering of claim 3, wherein the outer wall has approximately the same shape and size as the first side of the primary cell.

5. The covering of claim 3, wherein the first crease of the first side, the second crease of the second side, and the crease of the outer wall each have an apex disposed in a common plane and oriented in a common direction.

6. The covering of claim 1, wherein the first and second creases are disposed in a common plane.

7. The covering of claim 1, wherein:
the second side includes a third crease and a fourth crease;
the third crease is positioned vertically between the top of the primary cell and the first crease;
the fourth crease is positioned vertically between the first crease and the bottom of the primary cell; and
the second crease is positioned vertically between the third and fourth creases.

8. The covering of claim 7, wherein the third and fourth creases are outer creases each having an apex directed away from the inner volume of the primary cell.

9. A covering for an architectural opening, comprising:
a head rail;
an end rail; and
a cellular panel operably connected between the head rail and the end rail, the cellular panel including at least one cellular unit, each cellular unit comprising:
a primary cell including an inner volume defined by:
a top;
a bottom vertically separated from the top;
a first side extending between the top and the bottom, the first side having a first crease; and
a second side laterally separated from the first side and extending between the top and the bottom, the second side having a second crease; wherein:
the first crease has an apex directed away from the inner volume of the primary cell;
the second crease has an apex directed towards the inner volume of the primary cell;
the second crease is defined in one of a front side or a rear side of the cellular panel; and
the first side extends towards one of the front side or the rear side of the cellular panel as the first side approaches the top, and the second side extends towards the other of the front side or the rear side of the cellular panel as the second side approaches the top.

10. The covering of claim 9, wherein the first crease and the second crease are positioned vertically equidistant between the top and the bottom of the primary cell.

11. The covering of claim 9, wherein each cellular unit further comprises an outer wall operably connected to the primary cell and extending around at least a portion of the first side of the primary cell to form a secondary cell.

12. The covering of claim 11, wherein the outer wall is coextensive in height with the first side of the primary cell.

13. The covering of claim 11, wherein the outer wall includes a crease that is aligned with the first crease and the second crease.

14. The covering of claim 9, wherein:
the second side includes a third crease and a fourth crease;
the third crease is positioned vertically between the first crease and the top of the primary cell; and
the fourth crease is positioned vertically between the first crease and the bottom of the primary cell.

15. The covering of claim 14, wherein the third and fourth creases each have an apex directed away from the inner volume of the primary cell.

16. The covering of claim 14, wherein the third crease is positioned vertically equidistant between the first crease and the top of the primary cell.

17. The covering of claim 16, wherein the fourth crease is positioned vertically equidistant between the first crease and the bottom of the primary cell.

18. A cellular shade comprising:
at least two cellular units, each cellular unit including:
an inner cell including:
a top;
a bottom;
a first side having a first pleat and extending between the top and the bottom; and
a second side having a second pleat and extending between the top and the bottom, the second pleat disposed vertically between the top and the bottom of the inner cell; and
a lift mechanism for extending and retracting the at least two cellular units and including a lift cord extending through an inner volume of the inner cell, wherein:
the first pleat is an outer pleat having an apex directed away from the inner volume of the inner cell;
the second pleat is an inner pleat having an apex directed towards the inner volume of the inner cell; and
the second pleat is defined in an exterior side of the cellular shade.

19. The cellular shade of claim 18, wherein each cellular unit includes an outer cell defined by an outer wall operably connected to the first side of the inner cell and including a single pleat, the outer wall having approximately the same shape and size as the first side of the inner cell.

20. The cellular shade of claim 19, wherein the single pleat of the outer cell is aligned with the first pleat of the first side.

21. The cellular shade of claim 19, wherein the second pleat of the second side is aligned with the first pleat of the first side and with the single pleat of the outer wall.

22. The cellular shade of claim 18, wherein:
the second side includes a third pleat and a fourth pleat disposed vertically between the top and the bottom of the inner cell; and
the third and fourth pleats are outer pleats each having an apex directed away from the inner volume of the inner cell.

23. The covering of claim 22, wherein one of the third and fourth pleats is positioned vertically between the second pleat and the top of the inner cell, and wherein the other of the third and fourth pleats is positioned vertically between the second pleat and the bottom of the inner cell.

24. The covering of claim 23, wherein the one of the third and fourth pleats is positioned vertically equidistant between the second pleat and the top of the inner cell.

25. The covering of claim 23, wherein the other of the third and fourth pleats is positioned vertically equidistant between the second pleat and the bottom of the inner cell.

26. The covering of claim 18, wherein the inner cell includes a drop ratio within a range of between approximately 0.20 to approximately 0.28.

* * * * *